United States Patent [19]

Yasuda

[11] Patent Number: 4,959,956

[45] Date of Patent: Oct. 2, 1990

[54] ROBUST EXHAUST MANIFOLD

[75] Inventor: Makoto Yasuda, Yokohama, Japan

[73] Assignee: Nissan Motor Co., Ltd., Yokohama, Japan

[21] Appl. No.: 286,830

[22] Filed: Dec. 20, 1988

[30] Foreign Application Priority Data

Dec. 21, 1987 [JP] Japan ..... 62-194685[U]

[51] Int. Cl.[5] ..... F01N 7/10

[52] U.S. Cl. ..... 60/323; 29/890.08

[58] Field of Search ..... 60/323; 29/157 R

[56] References Cited

U.S. PATENT DOCUMENTS

| | | | |
|---|---|---|---|
| 4,034,562 | 7/1977 | Taguchi | 60/323 |
| 4,373,329 | 2/1983 | Martini | 60/323 |
| 4,537,027 | 8/1985 | Harwood | 29/157 R |
| 4,689,952 | 9/1987 | Arthur et al. . | |

FOREIGN PATENT DOCUMENTS

| | | | |
|---|---|---|---|
| 591092 | 1/1960 | Canada | 29/157 R |
| 1286368 | 1/1962 | France | 60/323 |
| 2527263 | 11/1983 | France . | |
| 2058917 | 4/1981 | United Kingdom . | |
| 2058918 | 4/1981 | United Kingdom . | |

*Primary Examiner*—Douglas Hart

*Attorney, Agent, or Firm*—Pennie & Edmonds

[57] ABSTRACT

An exhaust manifold for a multicylinder type internal combustion engine, which comprises a plurality of branch tubes each having one end adapted to connect with an exhaust port of the engine; a gas gathering tubular member having the branch tubes connected thereto thereby to lead the exhaust gases produced by the engine thereinto through said branch tubes; and an outlet tube connected to the gas gathering tubular member to discharge the gases therefrom, wherein at least two of the branch tubes are integral with the gas gathering tubular member.

13 Claims, 3 Drawing Sheets

ROBUST EXHAUST MANIFOLD

BACKGROUND OF THE INVENTION

1. Field of the Invention

The present invention relates in general to exhaust manifolds for an automotive internal combustion engine, and more particularly to exhaust manifolds of a type which is simple in construction and exhibits excellent performance against a thermal stress applied thereto.

2. Description of the Prior Art

The exhaust manifold is connected to a cylinder head of an internal combustion engine to carry combusted gases away from the piston chambers of the engine. As is known, since the combusted gases from the piston chambers have very a high temperature, the exhaust manifold is constructed to have a considerable resistance against a thermal stress applied thereto by the gases. Furthermore, for unrestricted flow of the combusted gases from the piston chambers, the manifold is constructed to reduce a back pressure produced therein.

Thus, hitherto, various attempts have been taken for improving these performances.

Two of the exhaust manifolds hitherto proposed are disclosed respectively in FIGS. 4 and 5 of the accompanying drawings, which are described in Japanese Utility Model First Provisional Publication No. 59-148417.

The conventional exhaust manifold shown in FIG. 4 is of a type which is designed for a four-cylinder type internal combustion engine. The exhaust manifold has thus four branch tubes 41*a*, 41*b*, 41*c* and 41*d*, each having one end mated with an aperture formed in a steel flange member 42 and the other end mated with an aperture formed in a gas gathering tubular portion 43. The mated portions are welded. The flange member 42 is bolted to a cylinder head 44 of the engine in such a manner that the apertures of the flange member 42 are respectively mated with exhaust ports 45 formed in the cylinder head 44 of the engine. An outlet portion of the gas gathering tubular portion 43 has another flange member 46 welded thereto. For this connection, the flange member 46 has an aperture 46*a* into which the outlet portion of the tubular portion 43 is inserted. Thus, under operation of the engine, the combusted high temperature gases in the piston chambers are led through the exhaust ports 45 and the branch tubes 41*a*, 41*b*, 41*c* and 41*d* into the gas gathering tubular portion 43 and discharged therefrom through the outlet portion thereof.

The exhaust manifold shown in FIG. 5 is of a dual-manifold type and has four branch tubes 51*a*, 51*b*, 51*c* and 51*d*, each having one end mated with an aperture formed in a steel flange member 52 and welded thereto. The flange member 52 is bolted to a cylinder head 56 of an engine in such a manner that the apertures of the flange member 52 are respectively mated with exhaust ports 57 formed in the cylinder head 56 of the engine. The branch tubes 51*b* and 51*c* are joined at their outlet portions and welded to a first gas gathering tube 53*a*, while the branch tubes 51*a* and 51*d* are joined at their outlet portions and welded to a second gas gathering tube 53*b*. The outlet portions of the gas gathering tubes invention to provide an improved exhaust manifold which is free of the above-mentioned drawbacks.

According to the present invention, there is provided an exhaust manifold for a multicylinder type internal combustion engine. The exhaust manifold comprises a plurality of branch tubes each having one end adapted to connect with an exhaust port of the engine; a gas gathering tubular member having the branch tubes connected thereto thereby to lead the exhaust gases produced by the engine thereinto through said branch tubes; and an outlet tube connected to the gas gathering tubular member to discharge the gases therefrom, wherein at least two of the branch tubes are integral with the gas gathering tubular member.

BRIEF DESCRIPTION OF THE DRAWINGS

Other objects and advantages of the present invention will become apparent from the following description when taken in conjunction with the accompanying drawings, in which.

However, the above-mentioned conventional exhaust manifolds have the following drawbacks due to their inherent construction wherein each branch tube, each gas gathering tube and the main gas gathering tube are constructed of separate metal members and they are thus welded to one another for assembling the exhaust manifold.

First, the number of parts of the exhaust manifold is inevitably increased and assembly of the product thereby requires an increased number of production steps. Accordingly, production cost is increased.

Second, since the welded portions are numerous, the exhaust manifold thus produced fails to have a robust construction. In fact, during operation of the engine, there is produced a great temperature gap between the highly heated branch tubes and the less heated cylinder head, so that there arises a possibility that the welded portions will suffer cracking as the same undergoes repeated thermal expansion and shrinkage.

SUMMARY OF THE INVENTION

It is therefore an object of the present

DETAILED DESCRIPTION OF THE INVENTION

Figure 1A:
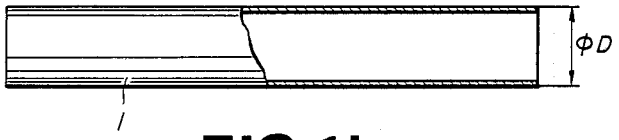
FIGS. 1*a*, 1*b*, 1*c* and 1*d* are partially cut back views of an exhaust manifold according to the present invention, showing steps for producing the manifold.
Figure 1B:
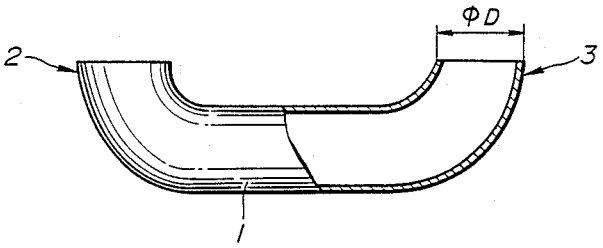
Figure 1C:
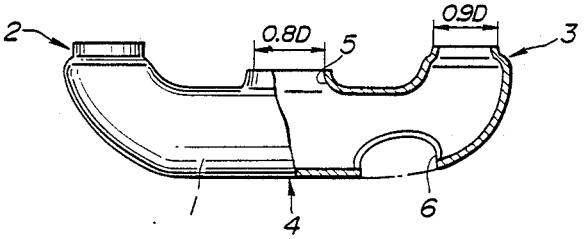
Figure 1D:
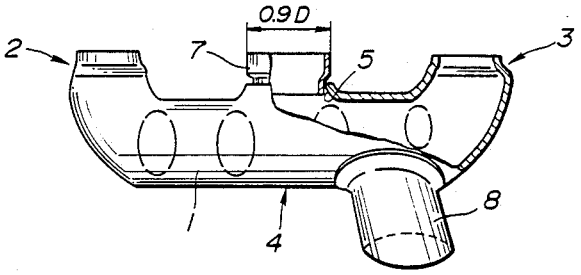
Figure 2:
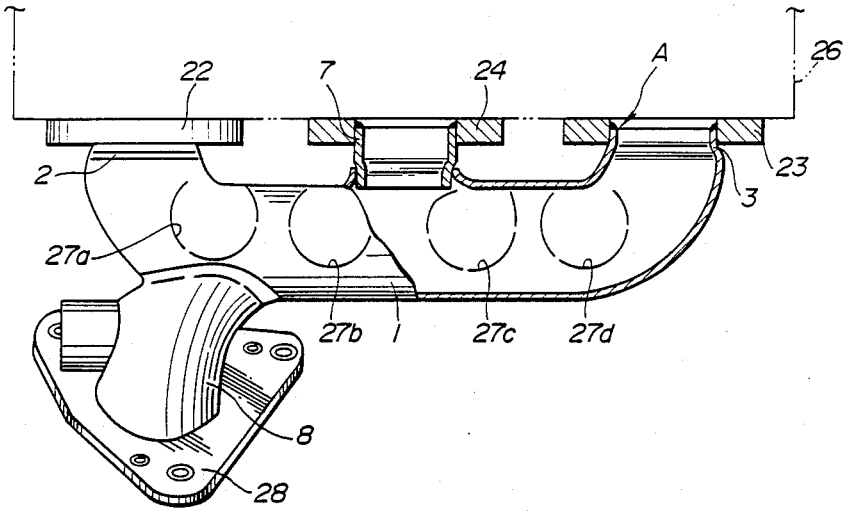
FIG. 2 is a partially cut plan view of the exhaust manifold of the present invention, showing a condition wherein the manifold is practically mounted to a cylinder head of an internal combustion engine.
Figure 3:
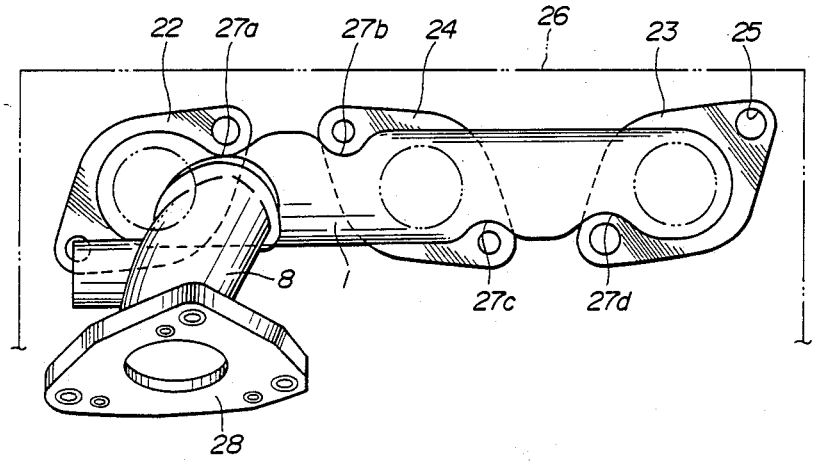
FIG. 3 is a front view of the exhaust manifold of the present invention.

Referring to FIGS. 1 to 3, there is shown an exhaust manifold according to the present invention, which is designed for a V-6 cylinder type internal combustion engine.

First, the steps for producing the exhaust manifold will be described with reference to FIGS. 1*a* to 1*d*.

A straight tube 1 constructed of stainless steel is prepared, which has an outer diameter of "D", as is seen from FIG. 1*a*. Then, as is seen from FIG. 1*b*, both ends 2 and 3 of the tube 1 are curved at generally right angles with a radius of curvature of "R". Then, as is seen from FIG. 1*c*, the curved end portions 2 and 3 are drawn by a drawing method to have smaller diameter end portions of about "0.9D" in diameter. Then, by using a burring method, the tube 1 is formed at its center part 4 with an opening 5 of about "0.8D" in diameter. The peripheral portion of the opening 5 is raised for the purpose which will become apparent as the description proceeds. Then, the tube 1 is formed, at an opposite side of the side where the opening 5 is provided, with an opening 6 of "D" in diameter. In the illustrated embodiment, the opening 6 is located at a righthalf part of the tube 1 as viewed in FIG. 1*c*. Then, as is seen from FIG. 1*d*, a short or branch tube 7 constructed of stainless steel is mated at its reduced diameter end portion with the opening 5 and welded to the same. Furthermore, an outlet tube 8 of stainless steel is welded at its flanged end portion to the peripheral portion of the opening 6 of the tube 1. Preferably, the outer diameter of the outlet tube 8 is "D".

Figure 4:
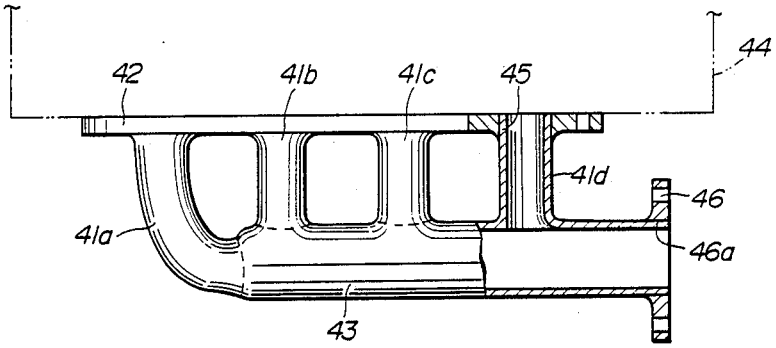
FIG. 4 (PRIOR ART)
FIG. 4 is a view similar to FIG. 2, but showing a first conventional exhaust manifold.
Figure 5:
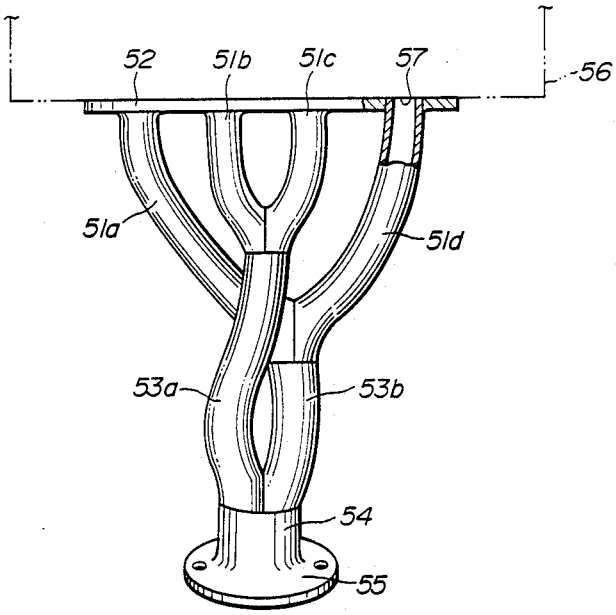
FIG. 5 (PRIOR ART)
FIG. 5 is a view also similar to FIG. 2, but showing a second conventional exhaust manifold. 53*a* and 53*b* are joined and welded to a main gas gathering tube 54. An outlet portion of the main gas gathering tube 54 has another flange member 55 welded thereto. Thus, under operation of the engine, the combusted gases in the piston chambers are led through the exhaust ports 57, the branch tubes 51*b*, 51*c*, 51*a* and 51*d* and the first and second gas gathering tubes 53*a* and 53*b* into the main gas gathering tube 54 and discharged therefrom through the outlet portion thereof.

With the above-mentioned production steps, a major part of the exhaust manifold of the invention is produced. It is to be noted that each of the curved end portions 2 and 3 constitute a so-called branch tube which corresponds to the branch tube 41*a* or 41*d* of the afore-mentioned conventional exhaust manifold of FIG. 4. That is, the branch tubes 2 and 3 and the major part of the tube 1 constitute a monolithic article.

A finished product of the exhaust manifold of the present invention is shown in FIGS. 2 and 3.

As shown in the drawings, flange members 22 and 23 of steel plate are welded to the curved end portions 2 and 3. More specifically, the leading end of each curved end portion 2 or 3 is inserted into an aperture of the flange member 22 or 23 and welded to the peripheral wall of the aperture. As is indicated by the arrow "A" in FIG. 2, the welded portion is tapered for a smooth flow of exhaust gases in the curved end portion 2 or 3. It is to be noted that the welding work is easily achieved because the same can be made from the back side of the flange member 22 or 23.

Similar to the above, another flange member 24 of steel plate is welded to the short tube 7.

The flange members 22, 23 and 24 are bolted to a cylinder head 26 of an internal combustion engine in a known manner. For this bolt connection, each flange member member 22, 23 or 24 is formed with two bolt holes 25. As will be understood from FIG. 3, the integrated portion 1 is formed with recesses 27*a*, 27*b*, 27*c* and 27*d* for facilitating handling of a tool by which the bolts are handled.

The outlet tube 8 has a flange member 28 welded thereto.

Under operation of the engine, the combusted gases in the piston chambers are led through the exhaust ports and the branch tube portions 2, 7 and 3 into the gas gathering tubular portion of the tube 1 and discharged therefrom through the outlet tube 8.

As is described hereinabove, the welded portion between each flange member 22, 23 or 24 and each branch tube portion 2, 7 or 3 is tapered. Thus, gas flow through the branch tube portions 2, 7 and 3 is smoothly effected thereby reducing the back pressure in the manifold.

Since the branch tube portions 2 and 3 and the gas gathering tubular portion are formed from a single tube 1 and the gas gathering tubular portion is shaped to extend linearly, the mechanical strength of the exhaust manifold is increased.

Furthermore, since the number of welded portions of the exhaust manifold is less than those of the afore-mentioned type conventional exhaust manifolds, the resistancy of the manifold against the thermal stress is much improved in the present invention.

Furthermore, since the number of parts of the manifold is small as compared with the afore-mentioned conventional manifolds, production cost of the manifold of the invention is reduced.

What is claimed is:

1. An exhaust manifold for a multicylinder type internal combustion engine, comprising:

a plurality of branch tubes each having one end adapted to connect with an exhaust port of said engine;

a gas gathering tubular member of a selected diameter having said branch tubes connected to thereby to lead the exhaust gases produced by said engine thereinto through said branch tubes; and an outlet tube connected to said gas gathering tubular member to discharge the gases therefrom, wherein at least two of said branch tubes are integral with said gas gathering member and are provided by curving both end portions of a single metal tube such that said end portions are drawn to have a smaller diameter than said tubular member diameter.

2. An exhaust manifold as claimed in claim 1, in which said single metal tube is constructed of stainless steel.

3. An exhaust manifold as claimed in claim 2, further comprising a separate branch tube which has one end welded to said gas gathering tubular member and the other end adapted to mate with one of the exhaust ports of the engine.

4. An exhaust manifold as claimed in claim 3, in which said outlet tube is welded to said gas gathering tubular member.

5. An exhaust manifold as claimed in claim 4, further comprising flange members which are welded to leading ends of said branch tubes.

6. An exhaust manifold as claimed in claim 5, in which each of said flange members has an aperture into which the leading end of the corresponding branch tube is inserted.

7. An exhaust manifold as claimed in claim 6, in which the leading end of said branch tube is welded to a peripheral wall portion of said aperture of the flange member leaving a welded portion which is shaped in a manner to smooth gas flow through the branch tube.

8. An exhaust manifold as claimed in claim 7, in which said outlet tube has at its leading end a flange member welded thereto.

9. An exhaust manifold for use with a multicylinder type internal combustion engine, comprising:

a monolithic tubular body produced by drawing an curving a single straight metal tube, said tubular body including first and second terminal ends, which are opened to connect respectively to first and second exhaust ports of the engine, and a gas gathering tubular portion between said first and second terminal ends, said gas gathering tubular portion having a selected diameter:

at least one branch tube connected to said gas gathering tubular portion, said branch tube being adapted to connect to a corresponding additional exhaust port of the engine; and an outlet tube connected to said gas gathering tubular portion, wherein, in operation, the exhaust gases produced in the engine ar led from said first, second, and additional exhaust ports through said first and second terminal ends and said branch tube, respectively, into said gas gathering tubular portion and then discharged through said outlet tube.

10. An exhaust manifold as claimed in claim 9, wherein said first and second terminal ends are drawn to have an end portion of smaller diameter than said gas gathering tubular portion diameter.

11. An exhaust manifold as claimed in claim 10, in which said tubular body is curved to have a generally C-shaped configuration such that the openings of said first and second terminal ends and of said branch tube each face in the same direction.

12. An exhaust manifold as claimed in claim 11, in which said branch tube is welded to said gas gathering tubular portion.

13. An exhaust manifold as claimed in claim 12, in which said outlet tube is welded to gas gathering tubular portion.

* * * * *